US005314403A

United States Patent [19]

Shaw

[11] Patent Number: 5,314,403

[45] Date of Patent: May 24, 1994

[54] APPARATUS FOR THE ENHANCEMENT OF THE ENJOYMENT OF THE EXTREMELY LOW FREQUENCY COMPONENT OF MUSIC

[76] Inventor: Richard T. Shaw, 13003 SE. Hwy. 212, Clackamas, Oreg. 97015

[21] Appl. No.: 995,185

[22] Filed: Dec. 22, 1992

Related U.S. Application Data

[63] Continuation-in-part of Ser. No. 824,069, Apr. 24, 1992, abandoned.

[51] Int. Cl.[5] ..... A61H 1/00

[52] U.S. Cl. ..... 601/148; 297/217; 5/916; 5/933; 601/57; 601/55

[58] Field of Search ..... 128/33, 64, 65, 32; 5/449, 451, 455, 654, 904, 915, 916, 933; 297/454, 455, 452, 217

[56] References Cited

U.S. PATENT DOCUMENTS

| | | | |
|---|---|---|---|
| 2,821,191 | 1/1958 | Paii | 128/33 |
| 3,880,152 | 4/1975 | Nohmura | 128/33 |
| 4,023,566 | 5/1977 | Martinmass | 128/33 |
| 4,189,181 | 2/1980 | Noble et al. | 297/455 |
| 4,391,466 | 7/1983 | Smith | 297/452 |
| 4,507,816 | 4/1985 | Smith, Jr. | 5/451 |
| 4,538,596 | 9/1985 | Colasante | 128/32 |
| 4,757,548 | 7/1988 | Fenner | 128/33 |
| 4,929,026 | 5/1990 | Barbelet | 257/454 |
| 5,076,260 | 12/1991 | Komatsu | 128/33 |
| 5,086,755 | 2/1992 | Schmid-Eilber | 128/33 |
| 5,097,821 | 3/1992 | Eakin | 128/33 |
| 5,101,810 | 4/1992 | Skille | 128/33 |
| 5,113,852 | 5/1992 | Murtonen | 128/33 |

*Primary Examiner*—Robert A. Hafer
*Assistant Examiner*—David J. Kenealy
*Attorney, Agent, or Firm*—Chernoff, Vilhauer, McClung & Stenzel

[57] ABSTRACT

A device for enhancing enjoyment of electronically reproduced music including a chair with liquid-filled bladders coupled to transducers such as electromagnetic driver assemblies responsive to audio-frequency electrical signals. A diaphragm of elastic sheet material provides support for part of the bladder and part of the transducer. Bladders and transducers are located in the seat and back of the chair, and the transducers move the liquid in the bladders, so that movement of the liquid can be felt by a user sitting in the chair. The electrical signals are preferably filtered to pass only bass frequencies to the transducers.

10 Claims, 8 Drawing Sheets

APPARATUS FOR THE ENHANCEMENT OF THE ENJOYMENT OF THE EXTREMELY LOW FREQUENCY COMPONENT OF MUSIC

This application is a continuation-in-part of copending patent application No. 07/874,069, filed Apr. 24, 1992, now abandoned.

BACKGROUND OF THE INVENTION

The present invention relates to devices and methods for enhancing enjoyment of electronically reproduced music.

Advances in audio technology have resulted in systems capable of quite accurately reproducing music over the entire range of audibility (approximately 12-20,000 Hertz). A multitude of individual audio components are available that may be combined to reproduce music having very little distortion of the input audio signal. These audio systems are also capable of producing sounds at a very high amplitude.

The enjoyment of listening to music is not limited to auditory perception, but in addition, it includes the receiving of the acoustic vibrations of music through the body. The human body "feels" vibrations primarily in the extremely low frequency (hereinafter ELF or bass), range of less than 250 Hertz. Unfortunately, in order to generate a bass level of sound that is enjoyable in this manner, it is often necessary to turn the volume level of the system up to a very high level. The result may be a volume that may injure the ears of people in close proximity or disturb people in adjacent areas. Quite often bass levels that are sufficiently loud to be enjoyed by intended listeners are transmitted through walls and ceilings, disturbing the unintended. Alternatively, the audio system controls may be adjusted to provided more bass and/or less treble, but this results in a distorted output.

Paii U.S. Pat. No. 2,821,191 discloses a pulsating device, in particular, a treatment table wherein pulsations produced are controlled somewhat in proportion to the volume of sound waves emanating from a loudspeaker. In Paii, the variations in vibration from a speaker are used to control the current delivered to a pulsator motor. Connected to the output shaft of the pulsator motor are eccentrics. It is the movements of these eccentrics that create the vibrations perceived by the user of the device.

Nohmura U.S. Pat. No. 3,880,151 discloses a health promoting device comprising a chair or a bed with loudspeakers incorporated within to generate rhythmical vibrations. The sounds generated by the loudspeakers are propagated through an air space between the speakers and the surface of the chair or bed before they reach the person resting upon the chair or the bed.

Martinmaas U.S. Pat. No. 4,023,566 discloses the use of loudspeakers in either chairs or beds, where the speakers are mounted in chambers filled with air facing the body support structure. The speakers produce vibrations within the chamber which are propagated through the air within the chamber to reach and be heard before they are felt by the occupant.

Smith U.S. Pat. No. 4,507,816 discloses a sound wave system for use with a water bed where sounds from loudspeakers located in individual airtight speaker enclosures are directed upwardly through the air within the speaker enclosure into the water-filled mattress to create water waves and vibrations that are synchronized with the sound.

All of the above-described devices have the goal of producing vibrations that are representative of the full range of frequencies contained in the source music. With the exception of the Paii device, all of the prior apparatus relies upon the transmission of sound waves through air prior to being absorbed into the body.

Because sound waves spread widely in air, especially at lower frequencies, it is difficult to create pleasant bass vibrations which can be felt within a human body, using air to transmit the sound, without disturbing people who do not want to hear the sound.

What is needed, therefore, is an improved apparatus that will allow the user to listen to a properly balanced audio output at a reasonable volume while enjoying feeling the bass vibrations.

SUMMARY OF THE INVENTION

The present invention answers the aforementioned need by providing an apparatus that allows the user to listen to a properly balanced audio output at a reasonable volume while also feeling vibrations created by the bass frequencies of the audio output. An apparatus for applying vibrations to a portion of a human body according to the present invention includes a transducer efficiently coupled to a flexible bladder substantially full of a liquid. An electrical signal drives the transducer, and the transducer creates vibrations within the liquid-filled bladder. When a portion of a human body contacts the bladder, the vibrations within the bladder are transmitted to that portion of the human body.

In a preferred embodiment of the invention, the apparatus includes a chair to seat the user. Cavities within the seat and back of the chair contain transducers and bladders. The flexible yet preferably inelastic liquid-filled bladder presses firmly against the covering of the back or seat of the chair. The transducer is supported in a position adjacent the bladder and is coupled intimately with the bladder in order to move the bladder efficiently, thus moving its liquid contents and a person's body supported by the bladder. Pressed firmly against the back side of the bladder is a resiliently elastic diaphragm which is attached to the front side of a mounting board which defines an opening through its center.

Attached to the back side of the mounting board is the transducer, which in a preferred embodiment of the invention resembles a loudspeaker that has been modified. The modified loudspeaker has only the electromagnetic driver assembly and part of the metal cone support frame of the original structure. Legs formed from the metal cone support frame firmly attach the modified audio loudspeaker to the back side of the mounting board. The electromagnetic driver assembly is centered within the opening in the mounting board and the face of the driver assembly is adhesively attached to the back side of the diaphragm so that the diaphragm provides a resilient mechanical suspension for the driver assembly.

In one embodiment of the transducer according to the invention the diaphragm is attached to the mounting board, and tightly stretched across the opening. The diaphragm provides support for the bladder and a person resting on the bladder and also supports the electromagnetic driver assembly, providing an elastic bias to support the driver assembly in a position where it will still be able to move in either direction when a person's weight is resting on the associated bladder.

An electrical signal, preferably in the ELF range, is applied to the driver assembly, which produces motion of the driver's face in response. Movements of the driver's face move the adjacent surface of the liquid-filled bladder, creating vibrations which are transmitted efficiently through the liquid to be felt by the portion of a human body contacting the portion of the chair above the transducer assembly.

It is contemplated that transducers other than modified loudspeakers will function quite adequately to create vibrations within the bladder. For example, other forms of electromagnetic components such as solenoids could be used as transducers. It is also possible that pneumatically driven transducers could be used.

It is contemplated that the source of the electrical signal to drive the transducer would be an audio electronics component such as a radio receiver or an amplifier and that the signal would be filtered by a graphic equalizer or other filter to include only ELF. It is also possible that other electronic signal sources or frequencies other than ELF could be used. Such devices as pulse generators, tone generators or even amplified electronic music instruments could provide acceptable electrical signals.

The present invention is more effective than prior inventions in providing vibrations related to the bass portions of music in a way in which they can be felt in a person's body. Unlike prior inventions that have used mechanical devices not controlled by music to create vibrations or that have propagated vibrations through air en route to the desired portion of a human body, in the present invention, vibrations are transmitted directly to and through the liquid-filled bladder and then into the human body. A liquid-filled bladder more closely resembles the composition of the human body than does an air-filled bladder, and accomplishes a more efficient transfer of vibrations and less attenuation of the vibrations.

It is therefore a principal object of the present invention to provide an improved apparatus for applying vibrations to a portion of a human body.

The foregoing and other objectives, features and advantages of the invention will be more readily understood upon consideration of the following detailed description of the invention, taken in conjunction with the accompanying drawings.

DETAILED DESCRIPTION OF THE DRAWINGS

Figure 1:
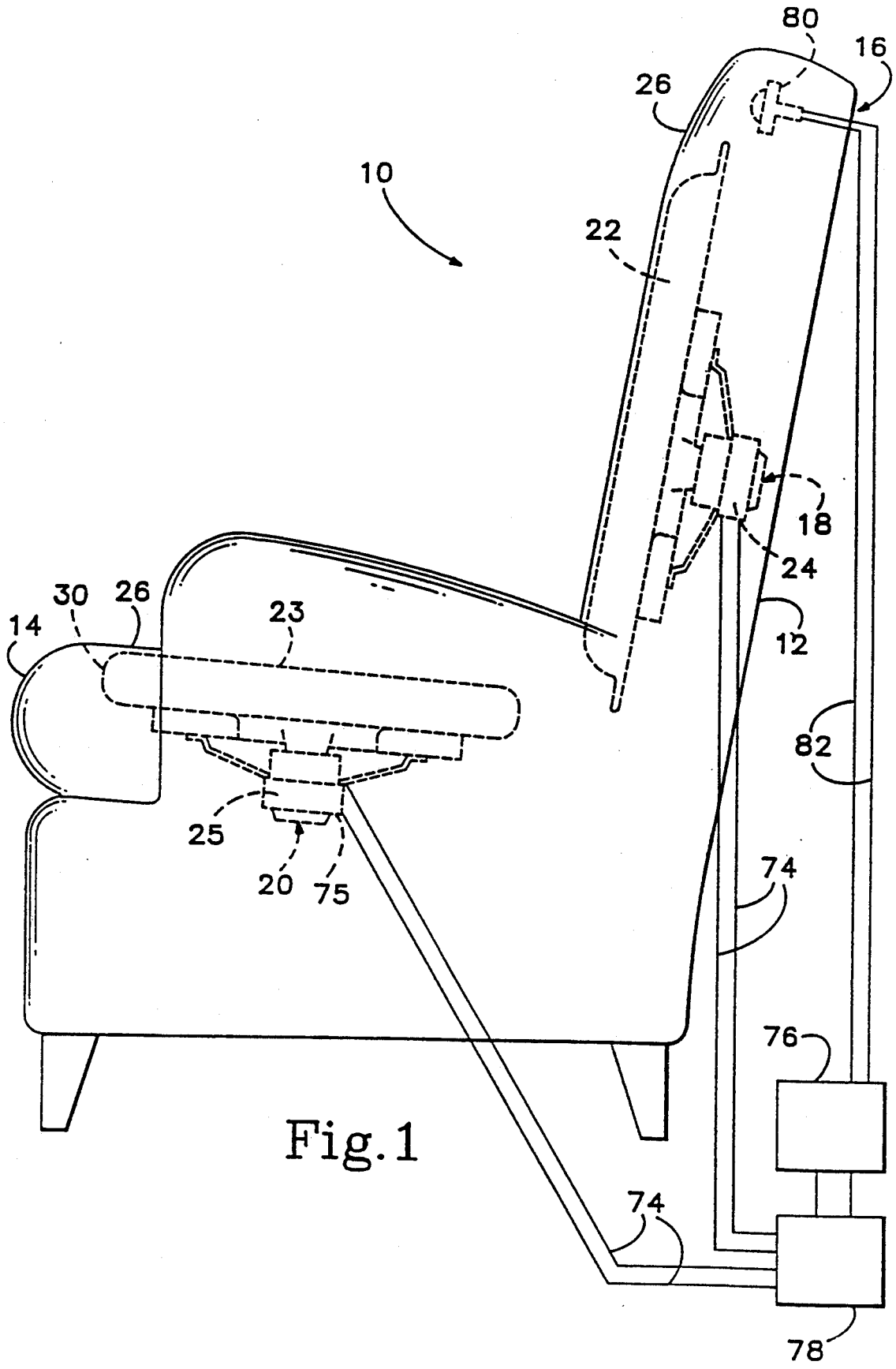
FIG. 1 is a side view of a chair embodying the invention.

Referring now to FIG. 1 of the drawings which form a part of the disclosure herein, an apparatus 10 for applying vibrations to a portion of a human body, as included in a chair 12, is shown. Within the seat 14 of the chair 12 is located a seat transducer assembly 20, having a flexible, liquid-filled bladder 23 and a transducer 25. Within the back 16 of the chair 12 is located a back transducer assembly 18 having a flexible liquid-filled bladder 22 and a transducer 24. When a person sits in the chair, his or her back and posterior rest on covering 26. Preferably, the covering 26 is a single thickness of cloth, leather or plastic material as is normally used to cover the cushioning foam, cotton, or other padding material of such a chair, although a layer of thermally insulative material (not shown) may also be included.

Figure 2:
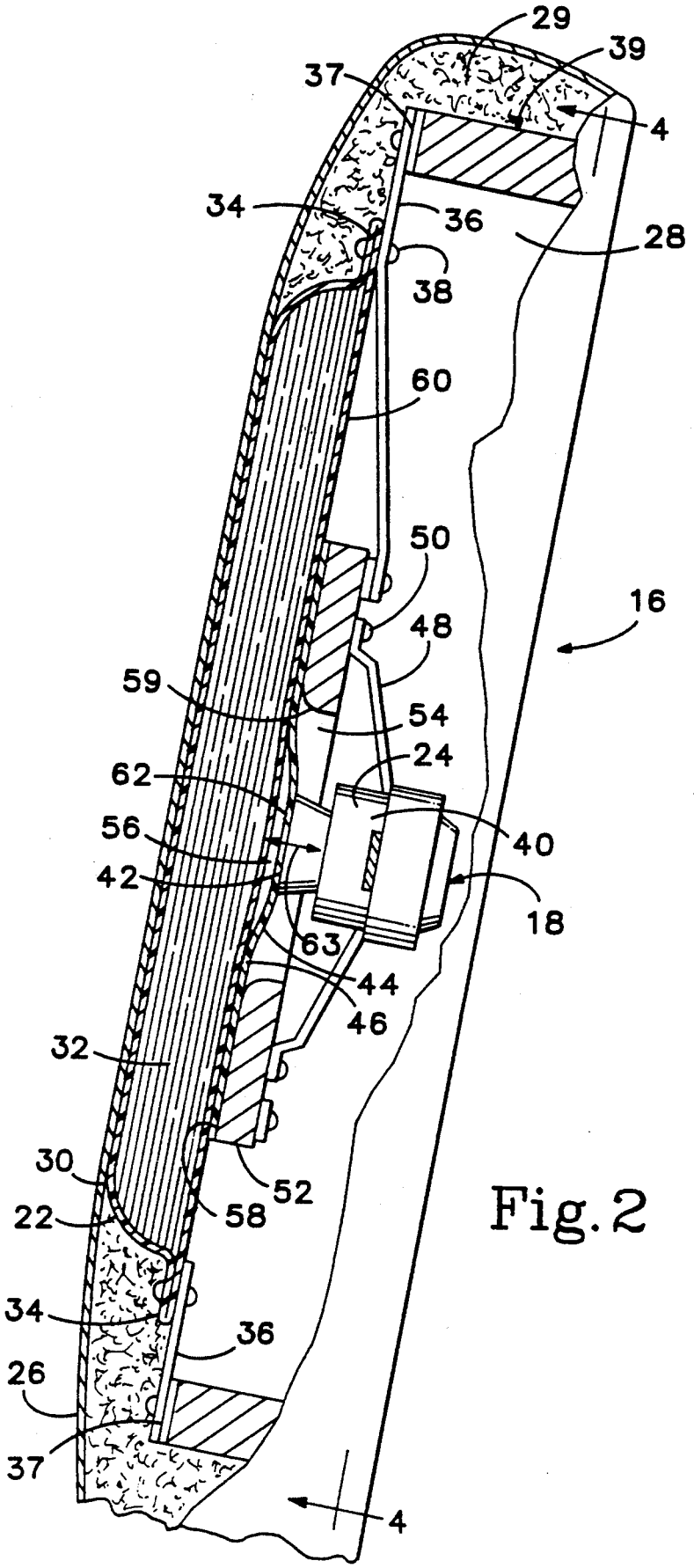
FIG. 2 is a partially cutaway view of the back of the chair shown in FIG. 1.
Figure 4:
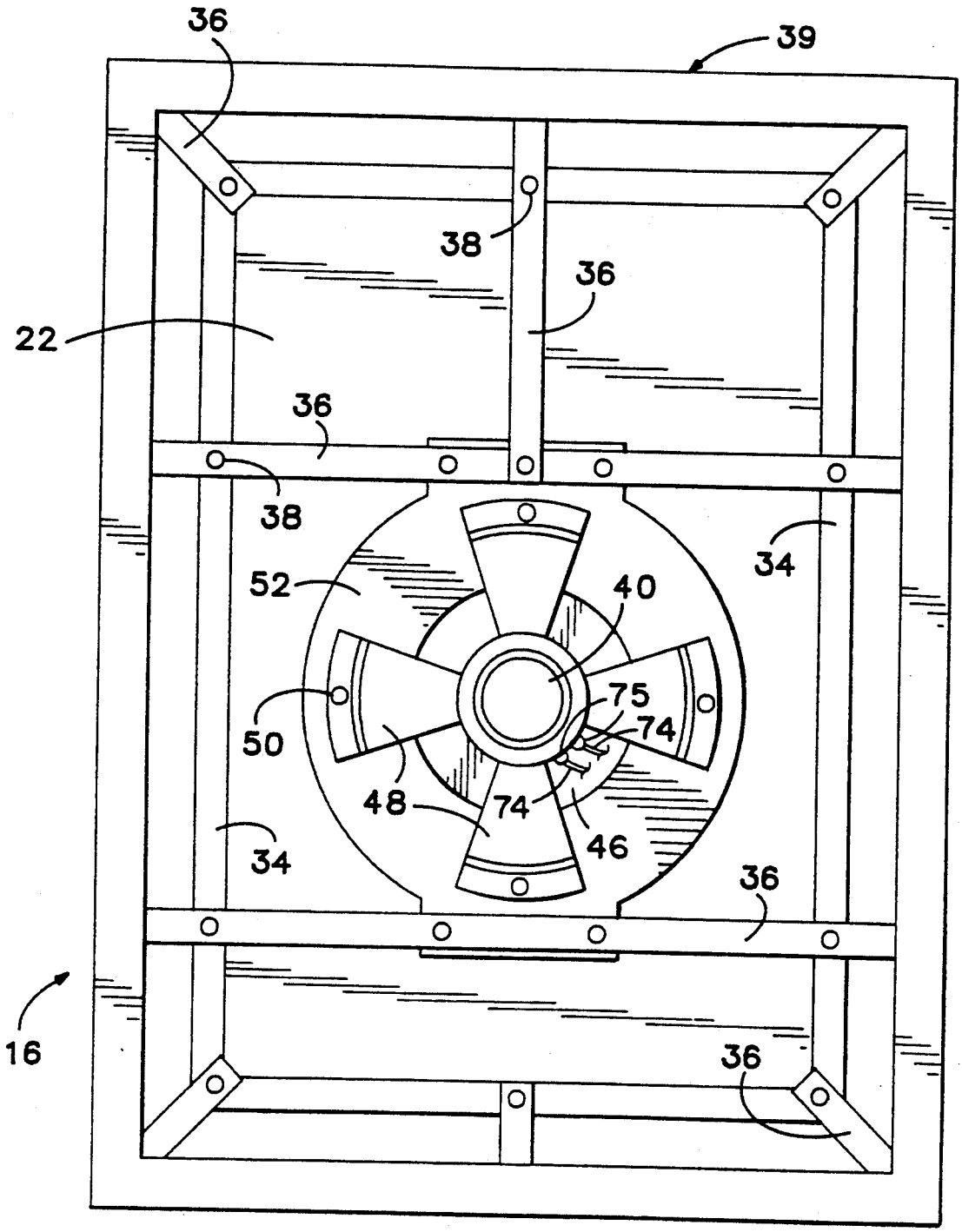
FIG. 4 is a view of a part of the frame of the back of the chair shown in FIGS. 1-3, together with the transducer assembly, taken along line 4—4 of FIG. 2.

As shown in FIGS. 2 and 4, the back 16 of chair 12 includes the back transducer assembly 18. Stuffing 29 in the back 16 is arranged to define a cavity 28 within which the back transducer assembly 18 is located.

Adjacent and pressing directly against the rear, or inner, face of the covering 26 of the back 16 is the front face 30 of the sealed bladder 22, which is filled with liquid and made of a flexible yet generally inelastic sheet material. The bladder 22 may be composed of any of numerous flexible materials formable into a liquid-tight container of the desired shape. Ideally the material chosen should also be inelastic so that the bladder 22 will not be deformed by stretching under the weight of a person's body. A suitable material is polyvinylchloride in sheet form having a thickness of about 20 to 24 mils. The bladder 22 is filled with a non-compressible liquid 32 such as water. Preferably, there should not be any air in the bladder 22. While other liquids having a viscosity or consistency different from water are contemplated as suitable substitutes for water, it appears that liquids having a density similar to that of the human body perform the best.

Figure 5:
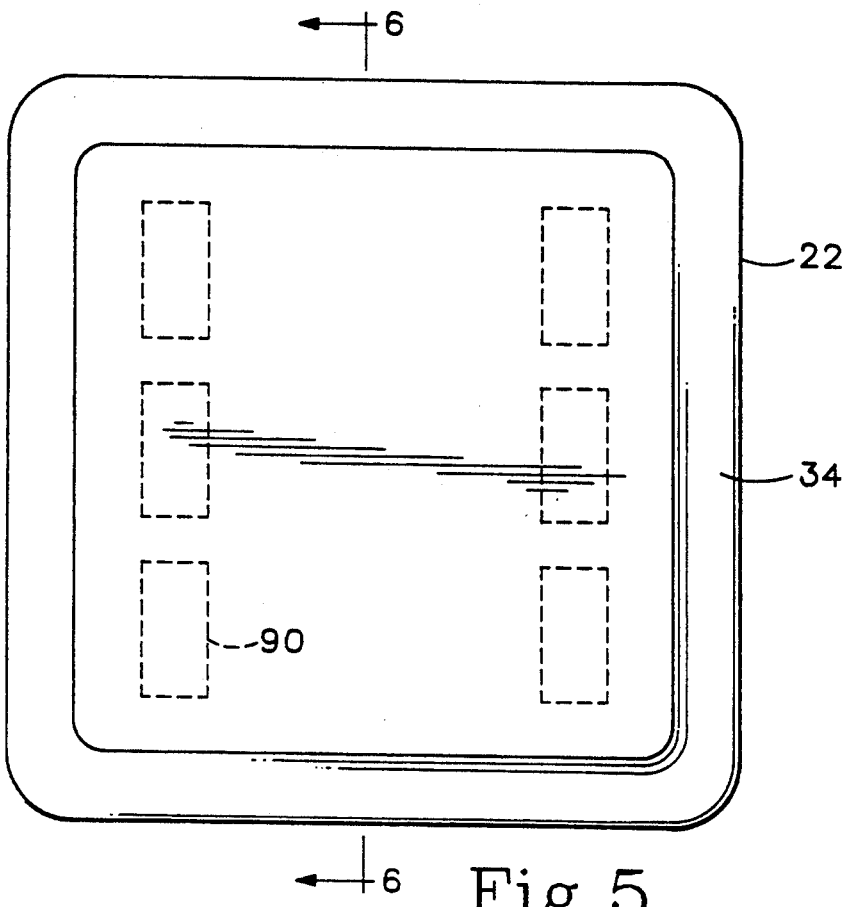
FIG. 5 is a front view of a bladder useful as part of one embodiment of the invention.
Figure 6:
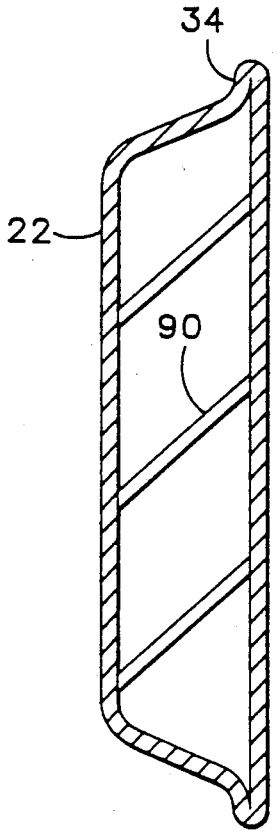
FIG. 6 is a cutaway view of the bladder shown in FIG. 5, taken along line 6—6.

Because the bladder 22 is oriented vertically, the weight of the liquid within the bladder may cause the bladder to tend to deform and bulge at the bottom. To counteract this tendency, narrow bridging strips 90, shown in FIGS. 5 and 6, may be included on the inside of the bladder 22 during its fabrication. These strips 90 are made from the same flexible, yet inelastic, material as the bladder 22 and are attached as to the inside of the bladder by using a suitable adhesive or thermal welding. The strips 90 preferably do not extend over the full width of the bladder 22 because doing so would create individual chambers within the bladder and might alter its performance.

The margin portion 34 of bladder 22 is reinforced, for example by a double thickness of the material forming the bladder 22, to enable the attachment of suspenders 36 by fasteners such as rivets, screws or nuts and bolts 38. The suspenders 36 are preferably strips of an elastomeric material such as polyethylene or polyvinyl chloride or a cloth-reinforced plastic. As shown in FIG. 4, these suspenders 36 extend horizontally and vertically to keep the back transducer assembly 18 positioned in its generally vertical orientation. The suspenders 36 also serve to isolate vibrations within the back transducer assembly 18 rather than allowing them to be transmitted to the frame 39 of the chair 12 as would happen were the back transducer assembly 18 attached to the framework 39 by an inelastic or rigid material.

If an inelastic or rigid material such as metal is used for suspenders 36, a damper such as a rubber grommet 37 (FIG. 2) may preferably be used between such a suspender and the chair frame 39 where connections are made, as shown in FIGS. 2 and 4.

The margin of the back side 44 of a diaphragm 46 is adhesively attached to the front side 58 of a mounting board 52 which may be made of any of numerous rigid materials such as plywood or particle board. Although it is expected that firm, direct contact will be made between the surfaces of the back side 60 of the bladder 22 and the front side 62 of the diaphragm 46, it is possible that a very small air pocket 56 may be formed directly opposite where the driver face 42 is firmly attached to the back side 44 of the diaphragm. If such an air pocket 56 is present, it should not greatly nor long interfere with the performance of the apparatus, because the air is soon pushed out of the air pocket 56 by operation of the apparatus.

The suspenders 36 also hold the transducer 24 in position with respect to the bladder 22 supporting the mounting board 52 with the front side 62 of the diaphragm 46 in contact with a substantial portion of the back side 60 of the bladder 22.

The back transducer 24 operates to vibrate the bladder 22 and the liquid 32 contained in the bladder 22. The back transducer 24 may be made from a loudspeaker such as a Pioneer B20GR30-51F-Q by modifying it. The electromagnetic driver assembly 40 and part of the metal cone support frame of the loudspeaker are used, as is shown also in FIG. 9. Legs 48 are formed from the metal cone support frame of the modified loudspeaker to provide points of attachment 50 to the mounting board 52. The mounting board 52 defines a centrally located hole or opening 54 extending through it. The electromagnetic driver assembly 40 is preferably centered over the opening 54 in the mounting board 52.

The driver assembly 40 has a driver face 42 which is firmly attached to the back side 44 of diaphragm 46, which is made of an elastic material. A rubber gasket material approximately 1/32" thick has been found to be adequate, for example, as the diaphragm 46. Movement of the driver face 42, which occurs in response to changes in the voltage of the electrical signal input, is generally in a forward and reverse direction as indicated by the arrow 63. The driver face 42 is urged outwardly by the stretched diaphragm 46 and is held in a position of equilibrium that is approximately the midpoint of the thickness of the mounting board 52. The attachment of the face 42 to diaphragm 46 is desirable because it helps keep movement of the voice coil and its foundation, such a support tube 101, or an equivalent moving part within the electromagnetic speaker driver assembly 40, from reaching its physical limit and bottoming out. The driver face 42 may be attached to the back side 44 of the diaphragm by a suitable adhesive, bearing in mind that the driver may move many millions of times during its life. A margin around the opening 54 on the front side 58 of the mounting board 52 has a radius 59 portion rather than a sharp edge. This radius 59 of about ½ inch has been found desirable to reduce a buzz that occurs if there is a sharp edge there.

Figure 3:
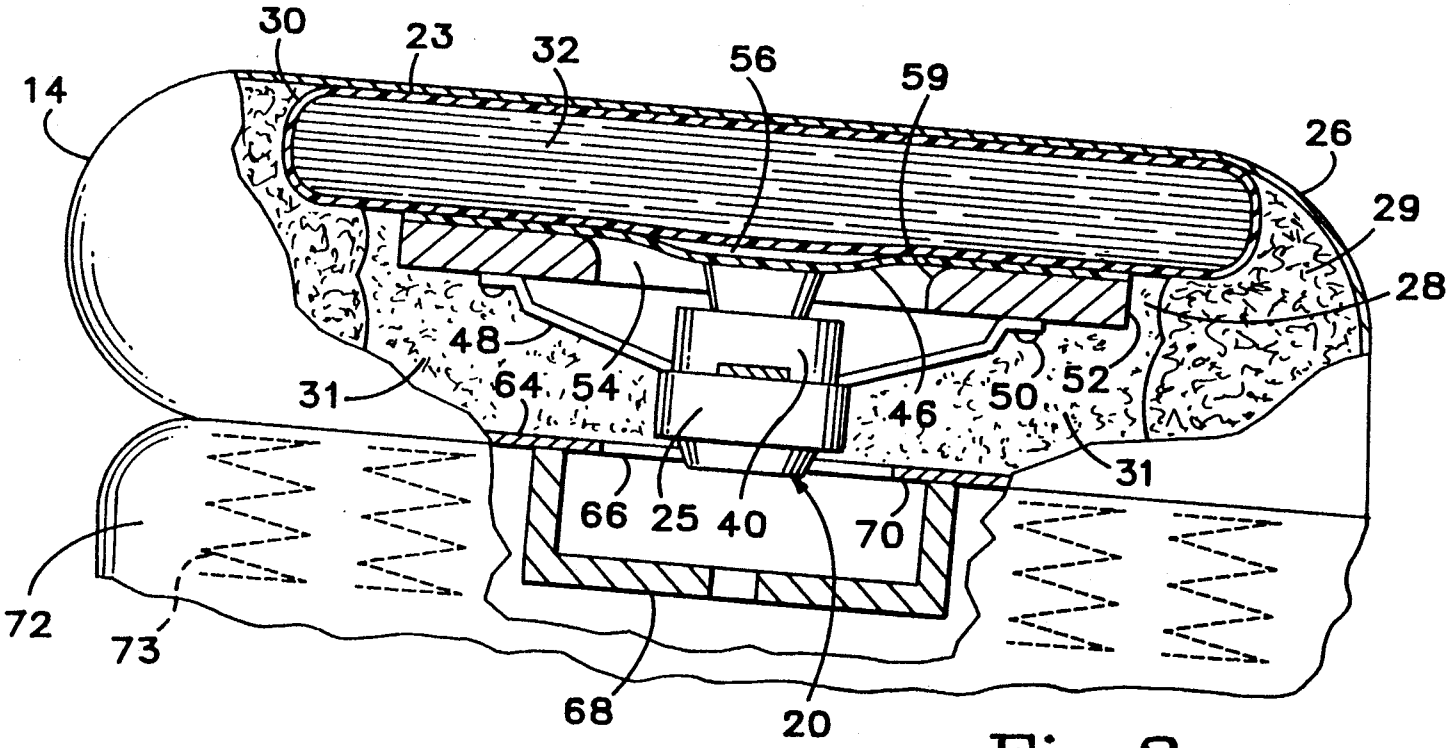
FIG. 3 is a partially cutaway view of the seat of the chair shown in FIG. 1, taken along line 3—3 of FIG. 1, at an enlarged scale.

FIG. 3 shows the seat transducer assembly 20 and seat bladder 23 located in the seat 14 of the chair 12. The seat transducer assembly 20 and seat bladder 23 are generally similar to the back transducer assembly 18 and back bladder 22 shown in FIG. 1, 2 and 4 and described above. Because the back transducer assembly 18 is mounted in an essentially vertical position and the seat transducer assembly 20 is mounted in an essentially horizontal position, the support structures used to mount them are one of the primary differences between them.

In order to hold the seat transducer assembly 20 and keep the front face 30 of seat bladder 23 firmly in contact with covering 26, in the chair 12 as shown in FIG. 3, a rigid plate 64 is mounted parallel to the seat bladder 23. The cavity 28 is filled with suitable resilient, supportive material 31, such as synthetic foam rubber, to support the transducer assembly 20 above the rigid plate 64. The rigid plate 64 is supported by the bottom portion 72 of the chair, including springs 74. A through hole 66 defined by the plate 64 accommodates a portion of the audio speaker driver 40 that extends downwardly.

A substantially airtight enclosure 68 extends downwardly from the bottom side 70 of the plate 64. This enclosure, which may be constructed of a suitable material with sound insulative properties, is desirable to contain sound vibrations within the seat transducer assembly 20 to isolate the seat assembly from the frame of the chair 12 and minimize transmission of those vibrations downwardly from the chair into the surrounding area where the sound might disturb other people. This enclosure 68 extends into the bottom portion 72 of the chair 12 between the springs 73 of the chair seat 14.

With reference now again to FIG. 1, as to both back transducer assembly 18 and seat transducer assembly 20, it is to be understood that the electromagnetic driver assemblies 40 have terminals whose positions are indicated at 75. Attached to these terminals are lead wires 74 that carry electrical signals in the form of current that causes movement within the electromagnetic driver assembly 40. The electrical signal supplied to the electromagnetic driver assembly 40 is preferably an audio-frequency signal in the ELF or bass range of between approximately 12 to 250 Hertz. This electrical signal could be the direct output of equipment such as an amplifier 76 amplifying signals in the audio frequency range of approximately 12–20,000 Hertz from a radio receiver, CD player, tape player, etc., or an electrical signal from such a source that is filtered by means of a graphic equalizer 78 or other well-known means to emphasize a desired frequency band.

It is also contemplated that a suitable electrical signal could be generated by means of many other devices, including pulse generators, tone generator or perhaps even amplified electronic music instruments. Difference in individuals' tastes will dictate what signal frequency and source create the most pleasing vibration, and the signals provided to the transducer assemblies 18 and 20 can be chosen to accommodate individual desires.

It is also contemplated that loudspeakers 80 could be incorporated into the back 16 of chair 12. The loudspeakers 80 could be connected electrically through lead wires 82 to receive the unfiltered output of amplifier 76. The listener sitting in the chair 12 would be able to enjoy hearing the full range of frequencies of music at an appropriate volume from the loudspeakers 80 while also feeling the bass vibrations in his back and posterior, as previously explained.

When an electrical signal from amplifier 76 is received by electromagnetic driver assembly 40, the driver face 42 moves in a forward and reverse direction, as shown by arrow 63 in FIG. 2, in response to the electrical signal. The movement of the driver face 42 causes two reactions. First, the driver face 42 causes the diaphragms 46 to move cyclicly toward and away from the respective bladders 22 or 23, flexibly deforming them accordingly. The liquid 32 within the bladders 22 and 23 is displaced and a physical wave-like motion which can be felt is created within the bladders 22 and 23. Second, in reaction to the force in the transducer assemblies causing the forward travel of the driver faces 42, mounting boards 52 move slightly in a rearward direction. As each driver face 42 moves rearward in response to a change in the electrical signal, the forces that pushed the mounting board 52 rearward are relaxed and the mounting board is, instead, pushed forward against the bladder 22 or 23, also creating movement of the liquid 32 within the bladder 22 or 23. The above actions, occurring separately or simultaneously, create the necessary movement within bladder 22 and 23 to allow the user to feel the vibrations.

In another embodiment (not shown), the apparatus of the invention might include one or more transducer assemblies including bladders located in the mattress of a bed. Although a bed is not shown in a separate drawing, reference to FIG. 5, which shows the horizontal placement of a seat transducer assembly 92 including a seat bladder 23, illustrates how and where a seat bladder 23 of a seat transducer assembly 92 could be located in a bed. The mattress of the bed would correspond to the seat 14 and the box springs would correspond to the bottom frame 72.

Figure 7:
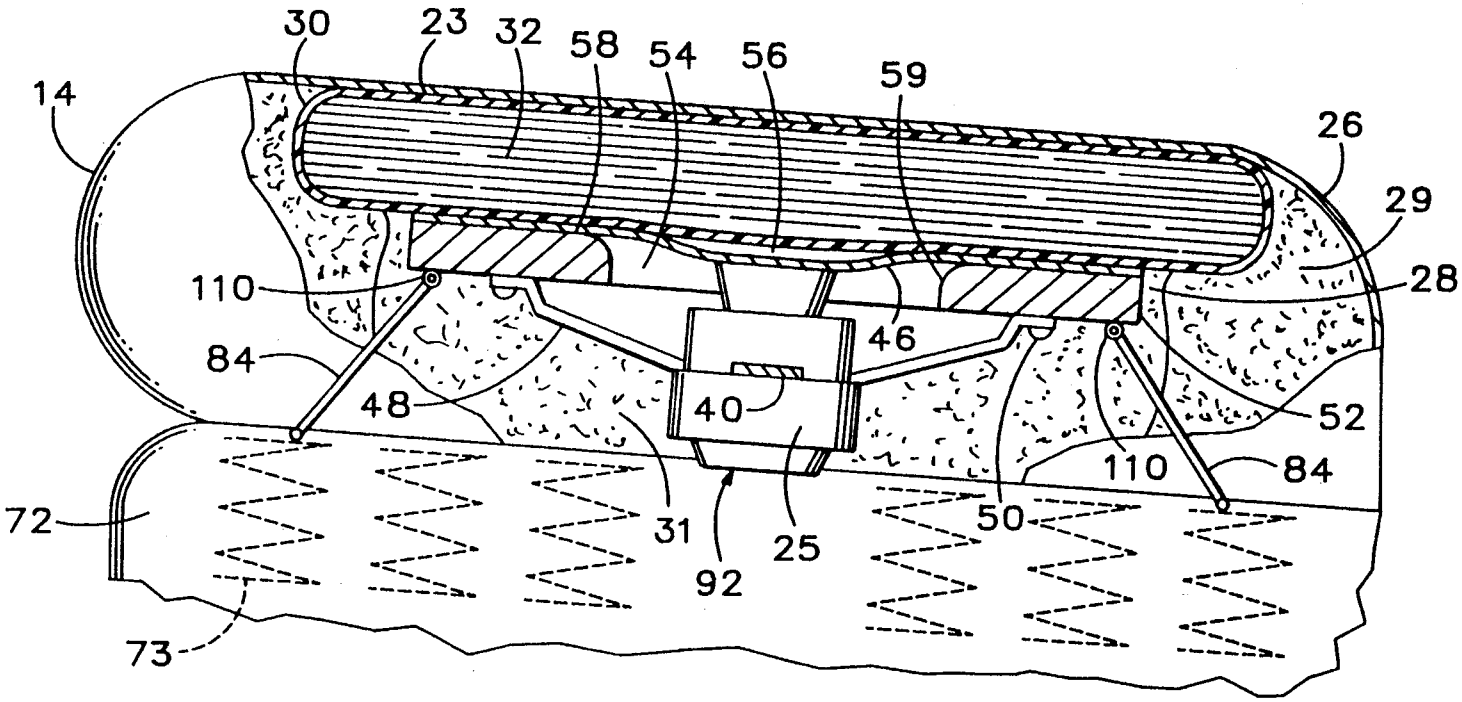
FIG. 7 is a partially cutaway view of the seat of a chair similar to the one shown in FIG. 1, taken along line 4—4 of FIG. 1, at an enlarged scale.

FIG. 7 shows another embodiment of the invention in which a seat transducer assembly 92, similar to the seat transducer assembly 25 including a transducer 25 and a seat bladder 23, is installed in the seat 14. In order to hold the seat transducer assembly 92 in the desired location, with the front face 30 of seat bladder 23 firmly in contact with covering 26, resilient supporting material 31, such as fiber fill or foam rubber or the like, is arranged within the cavity 28 in such a manner as to support the seat transducer assembly 92 above the springs 73 and prevent it from moving. In this embodiment of the invention the plate 64 and enclosure 68 shown in FIG. 3 are not used, and the supporting material 31 expected to dampen sound from the transducer 25. The supporting material 31 also prevents the transducer assembly 92 from moving downwardly under a person's weight.

Because the chair 12 or the seat 14 of the chair 12 may be moved or tipped over, it is desirable to keep the transducer assembly 92 in place within the seat 14 of the chair by use of elastic tie-downs 84, as shown in FIG. 7. The tie-downs 84 may be of an elastic cord such as a material commonly known as "shock-cord" which includes multiple, slender, parallel strands of rubber. One end of each tie-down 84 may be attached to the mounting board 52 by a connector 110 such as an eye bolt. The other ends of the tie-downs 84 may be attached to points on the inside of the seat 14. The seat transducer assembly 92 is thus secured against lateral movement by the tie-downs 84 within the seat 14.

Figure 8:
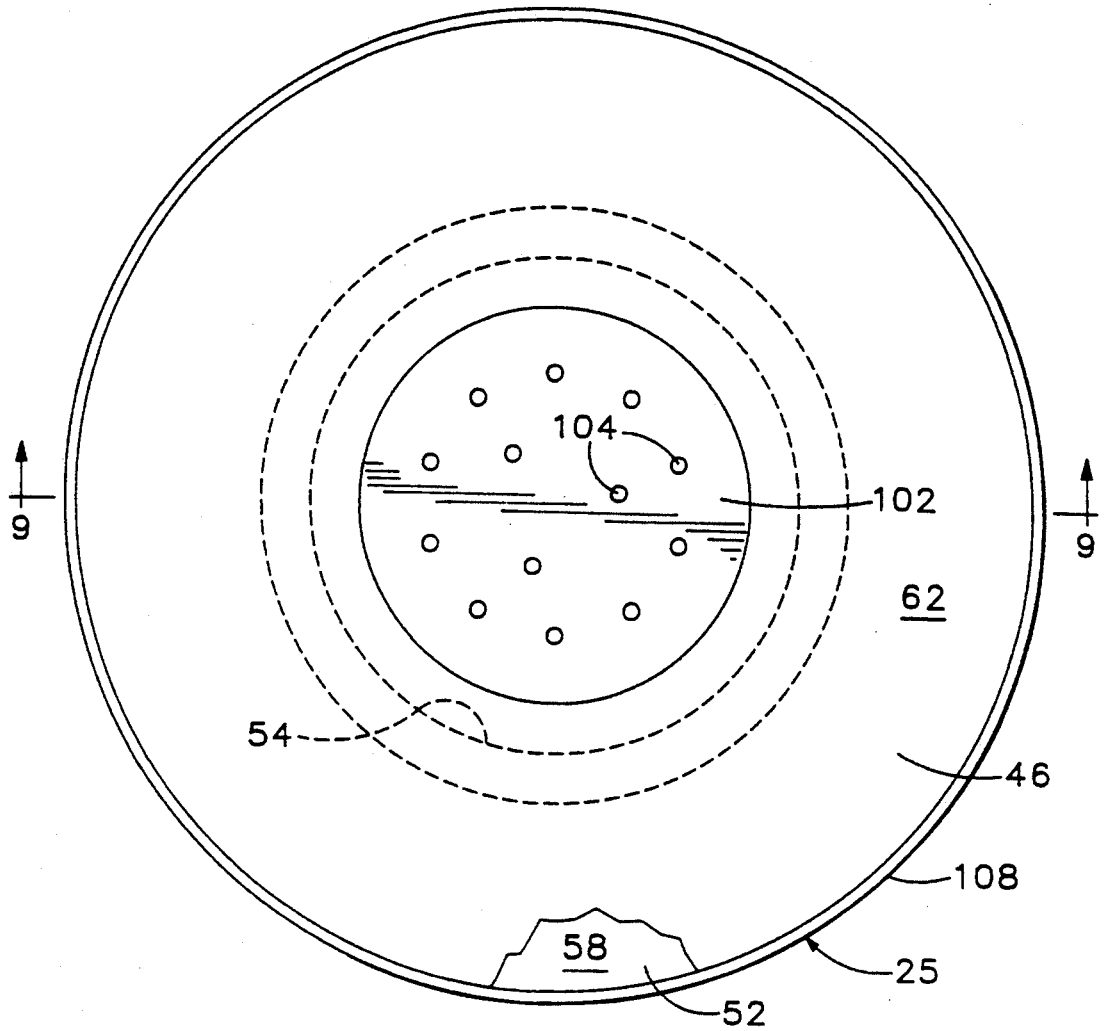
FIG. 8 is a front view of a transducer embodying the invention.
Figure 9:
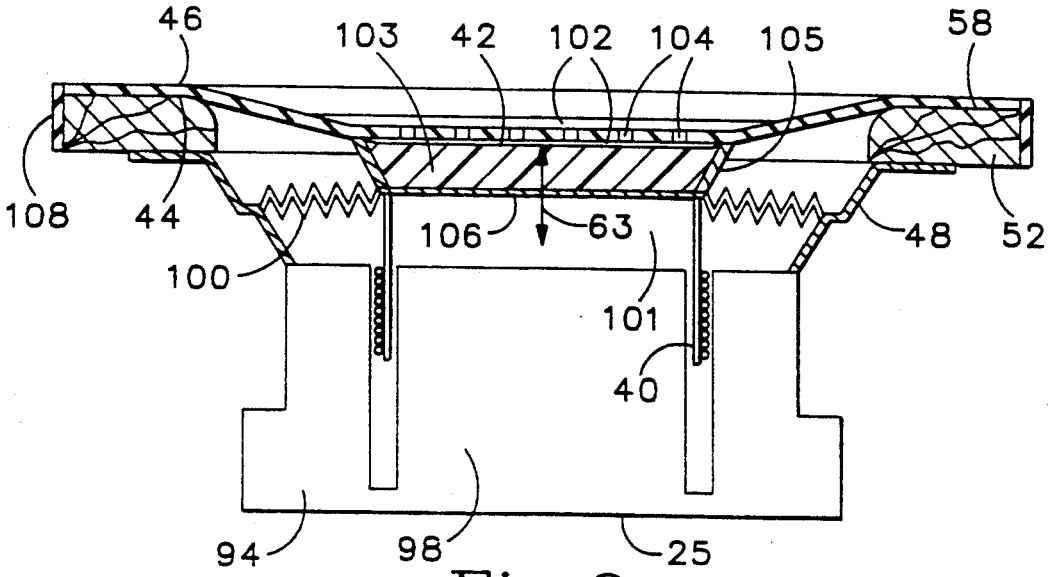
FIG. 9 is a cutaway view of the transducer shown in FIG. 8, taken along line 9—9 of FIG. 8.

FIGS. 8 and 9 show the seat transducer 25 in greater detail. The margin of the back side 44 of diaphragm 46 is adhesively attached to the front side 58 of a mounting board 52. The driver face 42 of driver assembly 40 is adhesively attached to the central portion of the back side 44 of diaphragm 46. This attachment causes the driver assembly to be biased and maintain a position extended away from the speaker magnet 98. This extended position should be chosen to permit reciprocal excursion of the driver in the directions indicated by the arrow 63, with the weight of the bladder 22 or 23 also being supported partially by the diaphragm 46, without damaging the flexible corrugated connection 100. A strip 108 of diaphragm material may be applied to the edge of mounting board 52 for cosmetic purposes.

The diaphragm 46, because it is elastic, is pulled slightly inward through the opening 54 where the diaphragm 46 is attached to the driver face 42. As mentioned previously, it is important to maintain firm, direct contact between the bladder 23 and the diaphragm 46. Adhesive tape 106 placed across the top of the voice coil support tube 101 of the transducer driver 40 supports a quantity of epoxy material 103 filling the short cone 105 at the front of the voice coil support tube, and forming the face 42. To eliminate the previously-mentioned potential small air pocket 56 that might result, the depression on the front face 62 of the diaphragm 46 is filled with a suitable material. It has been found that small holes 104 may be made through the diaphragm 46 and adhesive epoxy material 102 may then be poured to fill the downwardly deformed area on the front side 62 of the diaphragm 46. The holes 104 allow the epoxy to pass through the diaphragm 46 to adhere to the driver face 42.

It has been found that if a Pioneer B20GR30-51F-Q speaker is used for the transducer 94, between ¾ and 1 ounce of epoxy 103 and 102 will fill the cone 105, to form the face 42, and also fill the depressed central area of the diaphragm 46 and create a relatively flat diaphragm surface that will mate to the bladder 23 eliminating the likelihood of any air pocket being formed. Because some epoxy 102 is also on the back side of the diaphragm 46, the diaphragm 46 is partially encapsulated and securely adheres to the driver face 42.

It has also been found that the mass of the epoxy 103 forming the driver face 42 and the epoxy 102 filling the depression in the diaphragm 46 result in a transducer 25 with desired acoustic characteristics. The mass of the epoxy 102, 103 makes the transducer unresponsive to undesirable high frequencies. The low frequency vibrations, however, seem to be transmitted to the bladder with ample efficiency, thus creating enjoyable movement of the liquid with the bladder 22 or 23.

Figure 10:
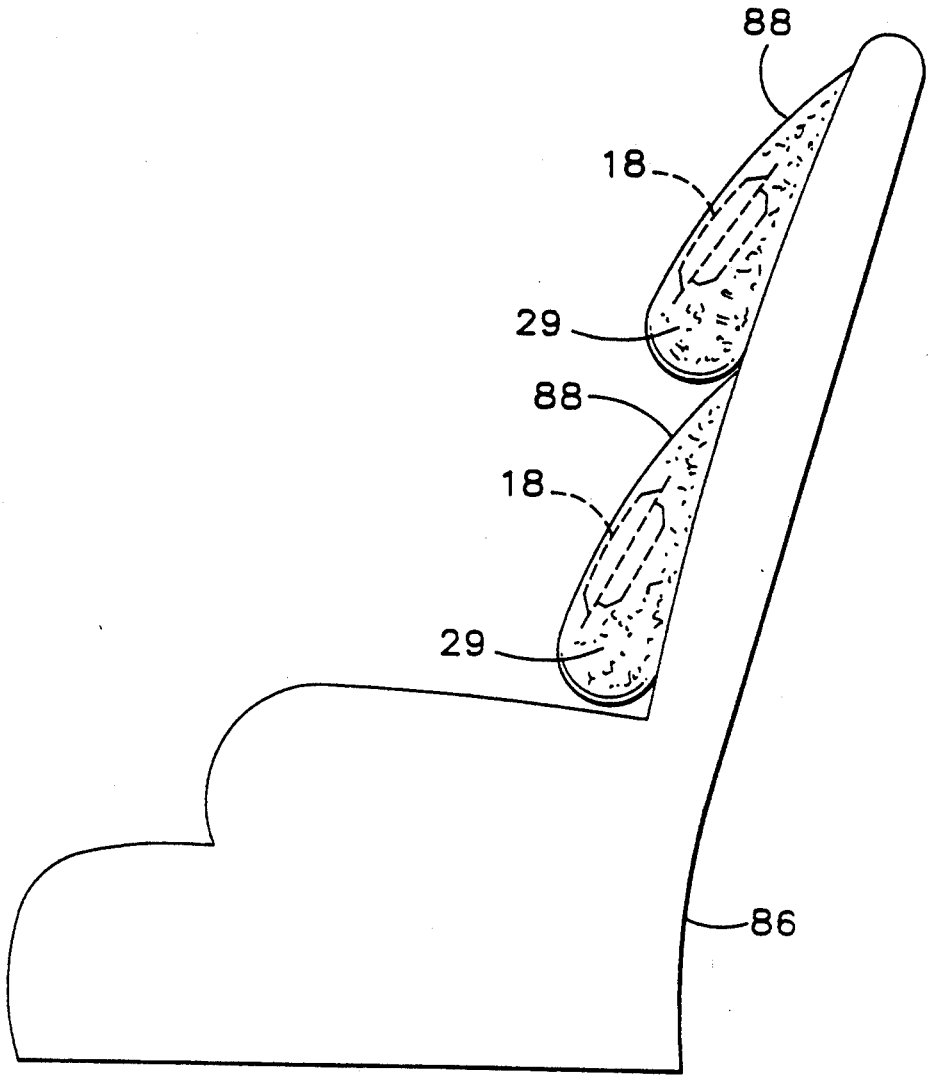
FIG. 10 is a simplified side view of a pillow back chair embodying the invention.

In another embodiment of the invention, shown in FIG. 10, a chair 86 of another style sometimes called a pillow-back chair, has layered pillows 88 suspended on the back of the chair. These pillows 88 have a structure similar to a bag and hang downwardly. A back transducer assembly 18 may be placed within one or more of these pillows. Placing and securing the back transducer assembly inside the pillow is relatively simple, such as by placing stuffing material 29, such as fiber-fill, foam rubber or the like in the respective pillow 88 so as to surround the back transducer assembly 18 and hold it in the desired position within the pillow 88.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. An apparatus for applying vibrations to a portion of a human body, comprising:

(a) at least one flexible bladder substantially full of a liquid;

(b) transducer means intimately coupled with said bladder for converting an electrical signal into a mechanical vibration and for moving a portion of said bladder in response to said electrical signal, said transducer means including an elastic diaphragm of generally planar elastic sheet material, having a front side and a rear side, said front side defining a depression filled with a solid material and said front side being in contact with said bladder, said transducer means further including means for supporting said diaphragm, and a driver having a face fixedly attached to said rear side of said diaphragm; and (c) support means for holding said bladder and said transducer means in position to support a portion of a human body.

2. The apparatus of claim 1 wherein said diaphragm is of generally planar elastic sheet material.

3. The apparatus of claim 1 wherein said flexible bladder is composed of an inelastic material.

4. The apparatus of claim 1, further comprising filter means for modifying said electrical signal to permit the selection of a desired frequency.

5. The apparatus of claim 4 wherein said desired audio frequency is in the extremely low frequency range.

6. The apparatus of claim 1, including an audio frequency signal generator as the source of said electrical signal.

7. Apparatus for applying vibrations to a human body, comprising:

(a) a frame defining a seat and a back;

(b) a flexible bladder associated with said back and having a front face and a back side;

(c) transducer means intimately coupled with said bladder for converting an electrical signal into a mechanical vibration and for moving a portion of said bladder in response to said electrical signal, said transducer means including:

(i) an elastic diaphragm having a front side and a rear side, said front side being in contact with said bladder, (ii) mounting board means defining an opening therethrough, for supporting said diaphragm stretched across said opening, and (iii) a driver having a face fixedly attached to said rear side of said diaphragm;

(d) support means interconnecting said bladder with said frame, for holding said bladder in position for said front face thereof to support a portion of a human body; and (e) flexible suspender means interconnecting said frame and said mounting board means, for supporting said transducer means in contact with said back side of said flexible bladder and isolating said frame from vibrations generated by said transducer means.

8. The apparatus of claim 7, including a second flexible bladder associated with said seat and having a front face, a second said transducer means intimately coupled with said second flexible bladder, and second support means for supporting said second transducer means beneath and supportingly in contact with said second flexible bladder.

9. The apparatus of claim 8, further including an enclosure located beneath said second transducer means for opposing transmission of vibrations downwardly from said seat.

10. The apparatus of claim 7 wherein said apparatus is a chair.

* * * * *